United States Patent [19]

Eisenstein

[11] 4,000,775

[45] Jan. 4, 1977

[54] HEAT EXCHANGER STRUCTURE

[75] Inventor: Albert Eisenstein, Akron, Ohio

[73] Assignee: The Babcock & Wilcox Company, New York, N.Y.

[22] Filed: Apr. 24, 1975

[21] Appl. No.: 571,138

[52] U.S. Cl. ..... 165/8; 165/10

[51] Int. Cl.[2] ..... F28D 19/04

[58] Field of Search ..... 165/8, 9, 10

[56] References Cited

UNITED STATES PATENTS 3,192,999 7/1965 Stockman ..... 165/9

3,891,029 6/1975 Mahoney ..... 165/8

*Primary Examiner*—Albert W. Davis, Jr.

*Attorney, Agent, or Firm*—Joseph M. Maquire; Robert J. Edwards

[57] ABSTRACT

A regenerative heat exchanger wherein the rotor-to-shaft connection includes axially spaced annuli fixed about the shaft and rigidly secured to the radial partitions of the rotor.

3 Claims, 3 Drawing Figures

HEAT EXCHANGER STRUCTURE

BACKGROUND OF THE INVENTION

The present invention relates to heat exchangers and more particularly to an improved construction for mounting the rotor assembly onto the shaft of a rotary regenerative heat exchanger.

In heat exchangers of the type under consideration, the rotor assembly is formed with a series of radial partitions circumferentially spaced about and carried by the shaft and including heat exchange elements disposed therebetween. The segmented rotor assembly is surrounded by a stationary housing having end plates formed with openings which direct the separate flow of a heating fluid and a fluid to be heated through the heat exchange elements. The separation of the two heat exchange fluids within the heat exchanger is accomplished through the use of sealing means which conform to the variations in clearance space between the housing and the rotor assembly. Such heat exchangers are normally constructed so that the axis of rotation for the rotor assembly extends along a line parallel to the flow path of the heat exchange fluids passing therethrough, with the heat exchange elements alternately absorbing heat from the heating fluid and yielding it to the fluid to be heated during each rotation of the rotor assembly. The fluid to be heated and the heating fluid are preferably in counter flow relation to one another with the inlet for the heating fluid and the outlet for the fluid to be heated being adjacent at one end of the heat exchanger, and the outlet for the heating fluid and the inlet for the fluid to be heated being adjacent the opposite end thereof. The rotor end facing the heating fluid inlet lies in a relatively high temperature zone and is commonly referred to as the "hot end" whereas the end facing the heating fluid outlet lies in a relatively low temperature zone and is commonly referred to as the "cold end". While the length of the flow path through the rotor assembly may be comparatively small, the temperature gradients occurring between the "hot" and "cold ends" are appreciable and lead to non-uniform thermal expansion and unequal stresses which often result in breakage of the rotor connection to the shaft.

SUMMARY OF THE INVENTION

The present invention provides an arrangement whereby the rotor attaches to the shaft through a plurality of separate connections spaced along the longitudinal extent of the shaft. During operation of the heat exchanger, the rotor-to-shaft connections are at different temperatures, however, each connection lies in a substantially isothermal zone giving rise, thereat, to a relatively uniform rate of thermal expansion. The connections comprise axially spaced annuli fitted about and rigidly fastened to the shaft. The rotor radial partitions are slotted to contiguously straddle the annuli in an axial direction and are rigidly fastened thereto. The arrangement includes flared plates which are rigidly fastened to the annuli and radial partitions to reinforce to rotor-to-shaft connections and distribute the load through the rotor along a flow path away from the connections.

DESCRIPTION OF THE PREFERRED EMBODIMENT

The regenerative heat exchanger depicted herein is of the type which normally employs hot gases as the heating fluid and air as the fluid to be heated.

Figure 1:
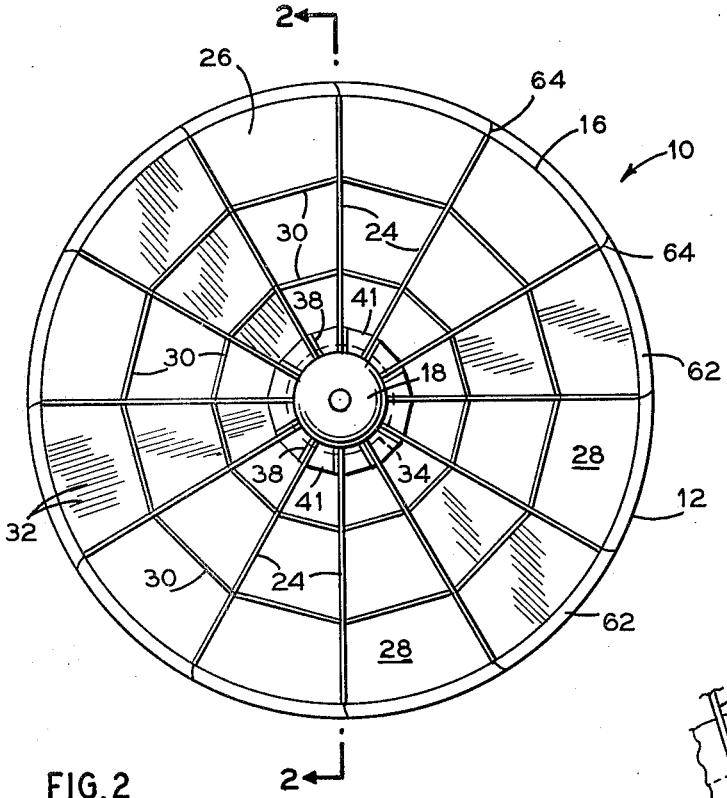
FIG. 1 is a sectional view of the regenerative heat exchanger embodying the invention.
Figure 3:
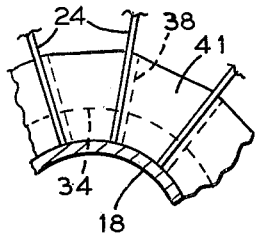
FIG. 3 is a detail view embodying the invention.
Figure 2:
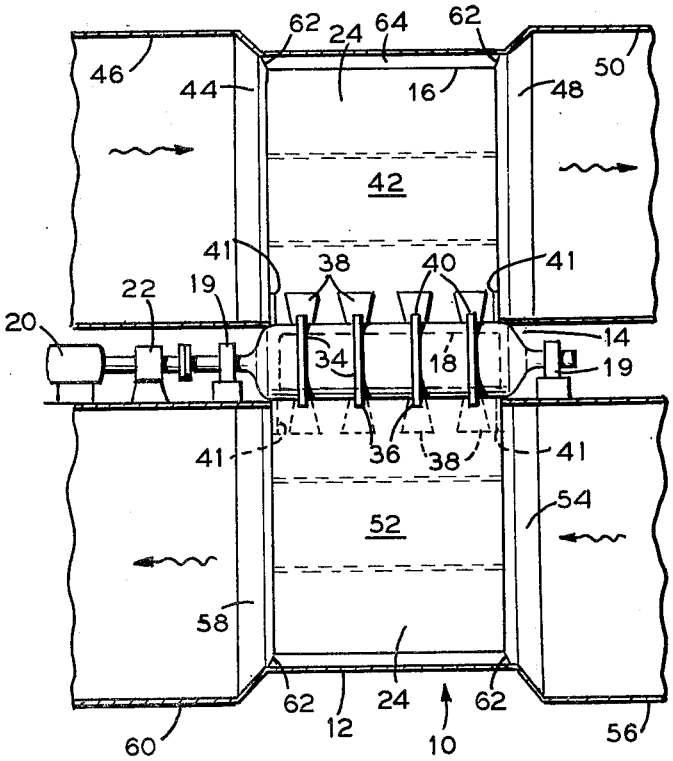
FIG. 2 is a sectional side view taken along line 2—2 of FIG. 1.

Referring to FIGS. 1, 2 and 3, there is shown a regenerative heat exchanger 10 including a housing 12 having a hub portion 14 and enclosing a cylindrical rotor 16, the latter being connected to a shaft 18 supported at bearings 19 and disposed within the hub portion 14. A drive motor 20 is coupled to the shaft 18 through a gear reduction box 22 to turn the rotor 16 slowly about its axis. The rotor 16 is segmented by a series of circumferentially equispaced radial partitions 24 which extend outwardly from the shaft to the periphery of the rotor 16, and form a plurality of open ended compartments 26 therebetween. The compartments 26 are in turn subdivided into sections 28 by radially spaced lateral partitions 30. The sections 28 contain regenerative heat exchange surface preferably in the form of closely spaced metallic plates 32 held together by a rigid framework.

In accordance with the invention, the shaft 18 is fitted with axially spaced annuli or ring-like members 34 that lie normal to the longitudinal extent of the shaft and are rigidly fastened thereto, preferably by welding. The rotor 16 connects with the shaft 18 through partitions 24 which have their radial inner ends formed with slots 36, the latter being shaped to contiguously straddle the annuli 34 in an axial direction. Flared plates 38 provide reinforcement at the juncture of the radial partitions 24 and the annuli 34. The plates 38 lie flat against one side of the radial partitions 24 and are formed with slots 40 that are shaped to contiguously straddle the annuli 34 in an axial direction. The connections between the rotor 16 and the shaft 18 are achieved through rigid fastening of the flared plates 38 to the radial partitions 24, and of their respective slotted edges to the annuli 34, preferably by welding. Accordingly, the rotor-to-shaft connections take place only at the annuli 34, with each connection disposed within a substantially isothermal zone. In addition to providing reinforcement at the rotor-to-shaft connecting points, the plates 38 are flared outwardly from the shaft 18 to distribute the load through the rotor 16 along a flow path directed away from the rotor-to-shaft connections. The regenerative heat exchange surface is positioned so that its radial inner end extends to the top edge of the flared plates 38. Seal plates 41 are provided to preclude leakage through the passageways formed between the heat exchange surface and the shaft 18. The plates 41 are located near the ends of the passageways and are rigidly fastened to the adjoining partitions 24 preferably by welding.

During the operation of heat exchanger 10, the rotor 16 turns about its axis and the metallic plates 32 pass slowly through a gas space 42 and absorb heat from the hot gas stream being delivered through an inlet opening 44 by a supply duct 46 connected to a vapor generator or other heat source. The spent gases are conveyed through an outlet opening 48 to a discharge duct 50. As the rotor 16 continues to turn about its axis, the heated plates 32 pass into an air space 52 and give up heat to an air stream being delivered through an inlet opening 54 by a supply duct 56. The heated air is conveyed through an outlet 58 to a discharge duct 60 for delivery to the vapor generator or other place of use. The air passing through the heat exchanger 10 will normally be at a higher pressure than the gas and a sealing arrangement is provided to bridge the space between the rotor 16 and the housing 12 thereby precluding leakage therethrough. The sealing arrangement includes radial seals, not shown, and circumferential seals 62 and axial seals 64 fastened to the peripheral edges of the rotor 16 and adapted to slide over the adjacent ends of the rotor housing.

With the gas flows as described, the rotor 16 and the shaft 18 lie between a relatively high temperature end located adjacent the gas inlet 44 and a relatively low temperature end located adjacent the gas outlet 48. The temperature gradients occurring between the "hot" and "cold ends" are appreciable and lead to non-uniform thermal expansion and unequal stresses which may have deleterious effects on rotor-to-shaft connections of the type that run along the longitudinal extent of the shaft, these stresses have been known to lead to tears of the radial partitions 24 and eventual failure of the rotor-to-shaft connection. Accordingly, the present invention provides an arrangement whereby the radial partitions 24 connected with the shaft through axially spaced annuli 34 that lie normal to the longitudinal extent of the shaft 18. Each of the annuli 34 and the connecting portions of the partitions 24 are disposed within a substantially isothermal zone giving rise to a relatively uniform rate of expansion at each of the connections. The arrangement also provides for plates 38 which reinforce the rotor-to-shaft connections and are flared outwardly from the shaft 18 to distribute the load through the rotor 16 along a flow path directed away from the rotor-to-shaft connections.

While in accordance with provisions of the statutes there is illustrated and described herein a specific embodiment of the invention, those skilled in the art will understand that changes may be made in the form of the invention covered by the claims, and that certain features of the invention may sometimes be used to advantage without a corresponding use of the other features.

The embodiments of the invention in which an exclusive property or privilege is claimed are defined as follows:

1. A regenerative heat exchanger comprising a rotatable shaft, a rotor concentrically disposed about said shaft, the rotor having radial partitions forming a plurality of sector shaped compartments and including regenerative heat exchange material disposed within said compartments, a housing surrounding the rotor and having inlet and outlet openings for directing the separate flow of a heating fluid and a fluid to be heated over said heat exchange material, the improvement including said shaft extending through a plurality of annular members rigidly fixed thereto, said members being spaced from one another and from the ends of the shaft, and notched plates straddling said members and being rigidly fixed thereto and to said partitions thereby connecting the rotor to said shaft.

2. The regenerative heat exchanger according to claim 1 wherein the partitions are notched to straddle said members.

3. The regenerative heat exchanger according to claim 1 wherein the plates are flared outwardly from said shaft.

* * * * *

UNITED STATES PATENT AND TRADEMARK OFFICE

CERTIFICATE OF CORRECTION

PATENT NO. : 4,000,775

DATED : January 4, 1977

INVENTOR(S) : Albert Eisenstein

It is certified that error appears in the above-identified patent and that said Letters Patent are hereby corrected as shown below:

Column 3, line 2; the word --opening-- should be inserted between "outlet" and "58".

Signed and Sealed this

*Seventeenth* Day of *January 1978*

[SEAL]

*Attest:*

RUTH C. MASON
*Attesting Officer*

LUTRELLE F. PARKER
*Acting Commissioner of Patents and Trademarks*